US008764178B2

(12) United States Patent
Tamanuki et al.

(10) Patent No.: US 8,764,178 B2
(45) Date of Patent: Jul. 1, 2014

(54) INK JET RECORDING METHOD AND INK JET RECORDING APPARATUS

(75) Inventors: Yukako Tamanuki, Tokyo (JP); Shogo Takemoto, Yokohama (JP); Kumiko Mafune, Kawasaki (JP); Yojiro Kojima, Tokyo (JP); Satoshi Kudo, Kawasaki (JP); Yoshio Kinoshita, Tachikawa (JP); Fumihiko Mukae, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 414 days.

(21) Appl. No.: 13/116,641

(22) Filed: May 26, 2011

(65) Prior Publication Data

US 2011/0310162 A1 Dec. 22, 2011

(30) Foreign Application Priority Data

Jun. 22, 2010 (JP) ..... 2010-141939

(51) Int. Cl.

| | |
|---|---|
| ***B41J 2/01*** | (2006.01) |
| ***B41J 11/00*** | (2006.01) |
| *B41J 2/21* | (2006.01) |
| *B41M 5/52* | (2006.01) |

(52) U.S. Cl.

CPC .. *B41J 2/01* (2013.01); *B41J 11/00* (2013.01); *B41J 2/2107* (2013.01); *B41M 5/52* (2013.01)

USPC ..... 347/102; 347/101; 347/100; 347/105

(58) Field of Classification Search

CPC ..... B41J 2/01; B41J 2/211; B41J 2/1433; B41J 2/17; B41J 2/17593; B41J 2/2107; B41J 2/1755; B41J 2/2114; B41J 11/0015; B41J 2/2056; B41J 2/21; B41M 5/52; C09D 11/36; C09D 11/40; C09D 11/30; C09D 11/38; C09D 11/322; C09D 11/328; C09D 11/101

USPC ..... 347/100, 95, 101, 102, 96, 105; 428/195, 32.1; 106/31.6, 31.13, 31.27; 523/160, 161

See application file for complete search history.

(56) References Cited

U.S. PATENT DOCUMENTS 5,617,516 A * 4/1997 Barton ..... 347/17
7,566,362 B2 7/2009 Mori et al.

(Continued)

FOREIGN PATENT DOCUMENTS

EP 0827841 A1 3/1998
JP 6-271798 A 9/1994

(Continued)

OTHER PUBLICATIONS

Mar. 26, 2012 European Search Report in European Patent Appln. No. 11004621.6.

(Continued)

*Primary Examiner* — Manish S Shah

(74) *Attorney, Agent, or Firm* — Fitzpatrick, Cella, Harper & Scinto

(57) ABSTRACT

An object of the present invention is to provide an ink jet recording method which gives an ink excellent anti-sticking properties and can suppress the occurrence of undertrapping when recording surfaces of recording media which each have an ink-receiving layer are overlapped with each other, and to provide an ink jet recording apparatus. The ink jet recording method of forming an image on the recording medium having the ink-receiving layer by ejecting an ink from an ink jet recording head, the method including performing at least one of drying the recording medium which has the image formed thereon and humidifying a gap between the recording head and the recording medium, wherein the ink to be used for forming the image is an ink which contains water, a water-soluble organic solvent and a specific compound.

10 Claims, 3 Drawing Sheets

(56) References Cited

U.S. PATENT DOCUMENTS

| | | | | |
|---|---|---|---|---|
| 7,615,113 | B2 | 11/2009 | Aikawa et al. | |
| 7,682,433 | B2 | 3/2010 | Yanagimachi et al. | |
| 7,699,924 | B2 | 4/2010 | Mafune et al. | |
| 7,878,643 | B2 | 2/2011 | Kudo et al. | |
| 7,918,928 | B2 | 4/2011 | Saito et al. | |
| 7,988,277 | B2 | 8/2011 | Moribe et al. | |
| 2007/0285456 | A1* | 12/2007 | Takasu et al. | 347/19 |
| 2008/0280041 | A1 | 11/2008 | Nishino et al. | |
| 2008/0280044 | A1 | 11/2008 | Okamura et al. | |
| 2009/0062545 | A1 | 3/2009 | Matsui et al. | |
| 2009/0238975 | A1 | 9/2009 | Yamakami et al. | |
| 2009/0238976 | A1* | 9/2009 | Ishii et al. | 347/100 |
| 2009/0258145 | A1 | 10/2009 | Mukae et al. | |
| 2009/0274839 | A1 | 11/2009 | Nakata et al. | |
| 2010/0033522 | A1 | 2/2010 | Saito et al. | |
| 2010/0033523 | A1 | 2/2010 | Suzuki et al. | |
| 2010/0034972 | A1 | 2/2010 | Mukae et al. | |
| 2010/0207975 | A1* | 8/2010 | Kawakami et al. | 347/106 |

FOREIGN PATENT DOCUMENTS

| | | | | | |
|---|---|---|---|---|---|
| JP | 06271798 | A | * | 9/1994 | B41J 2/01 |
| JP | 11-268256 | A | | 10/1999 | |
| JP | 11268256 | A | * | 10/1999 | B41J 2/01 |
| JP | 2000-103044 | A | | 4/2000 | |
| JP | 2005-298813 | A | | 10/2005 | |
| WO | 2007/077931 | A1 | | 7/2007 | |

OTHER PUBLICATIONS

Dec. 4, 2012 European Communication in European Patent Appln. No. 11004621.6.

* cited by examiner

INK JET RECORDING METHOD AND INK JET RECORDING APPARATUS

BACKGROUND OF THE INVENTION

1. Field of the Invention

The present invention relates to an ink jet recording method and an ink jet recording apparatus.

2. Description of the Related Art

An output form of an image is rapidly shifting from a silver halide system to an ink jet system due to such a tendency that the quality of an image obtained by an ink jet recording method becomes higher. Under such circumstances, the ink jet recording method is strongly required to enhance the output speed. Along with such requirement, a demand to enhance drying rate of ink is also increasing and many proposals have been made which aim at the enhancement. For instance, there is a proposal concerning a method of forming an image on a recording medium with ink and then drying the recording medium with a heating roller (See Japanese Patent Application Laid-Open No. 2000-103044).

In addition, it is required for ink along with the tendency of an increasing output speed to have such reliability including anti-sticking properties as to satisfy a severer level of performance. With respect to such an object, a recording method is proposed which can record information even on a material that is not ink-receptive, and can reduce the spread of water content from an ink droplet and the clogging in the recording head, for instance, by humidifying a gap between a recording head and the recording medium (See Japanese Patent Application Laid-Open No. H11-268256). In addition, an ink is proposed which has an enhanced ejectability including clogging resistance in the recording head by containing a water-soluble organic compound having water retentivity such as bis(2-hydroxyethyl)sulfone (See Japanese Patent Application Laid-Open No. 2005-298813).

SUMMARY OF THE INVENTION

Furthermore, in recent years, a so-called photograph book is rapidly becoming popular which is made into a form of an album or the like by binding recorded articles. Furthermore, opportunities of forming the photograph book by using an image formed with an ink jet recording method are also increasing.

However, it has been found that when recorded articles formed with the ink jet recording method are bound in a state in which a recording medium is folded so that the recording surface comes inside or in a state in which the recording surfaces of a plurality of recording media are overlapped with each other, a new problem occurs which will be described below. Specifically, when a recorded article has been preserved for a while in such a state that the faces of ink-receiving layers of recording media overlap each other, a white hazy unevenness having a shape of an image on one recording medium has appeared on another recording medium. In the present specification, a phenomenon which occurs in such a situation is hereafter referred to as "undertrapping." This undertrapping is remarkably recognized, particularly when images are formed on both of two overlapping recording surfaces. However, as long as an image is formed on at least one side of two overlapping recording surfaces, the undertrapping is slightly recognized even when an image is not formed in a region, of the other recording surface, which overlaps the above described image.

Accordingly, the present invention provides an ink jet recording method which gives excellent anti-sticking properties of ink and can suppress the occurrence of undertrapping when recording surfaces of recording media which each have an ink-receiving layer are overlapped with each other. The present invention also provides an ink jet recording apparatus which provides the above described prominent effect.

The above described object is achieved by the present invention which will be described below. Specifically, the ink jet recording method according to the present invention is an ink jet recording method having a step of forming an image on a recording medium having an ink-receiving layer by ejecting an ink from an ink jet recording head, the method including performing at least one of a drying step of drying the recording medium which has the image formed thereon and a humidifying step of humidifying a gap between the recording head and the recording medium, wherein the ink used for forming the image is an ink which contains water, a water-soluble organic solvent and at least one of a compound represented by the following General Formula (I) and a compound represented by the following General Formula (II):

$$R_1 + R_3 + R_2 \quad \text{(I)}$$

wherein the compound represented by General Formula (I) is solid at 25° C.; $R_1$ and $R_2$ each independently represent a hydrogen atom, a hydroxy group, a substituted or unsubstituted amino group, a substituted or unsubstituted alkoxy group, a substituted or unsubstituted aminooxy group, a substituted or unsubstituted alkyl group, a substituted or unsubstituted alkenyl group, a substituted or unsubstituted alkynyl group, a substituted or unsubstituted aralkyl group, a substituted or unsubstituted aryl group, or a substituted or unsubstituted heterocyclic group; and $R_3$ is one of —S—, —S(=O)— and —S(=O)$_2$—; and (II)

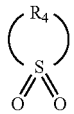

wherein the compound represented by General Formula (II) is solid at 25° C.; and $R_4$ is a molecular chain which constitutes a heterocycle together with a sulfur atom.

According to the present invention, there can be provided an ink jet recording method which gives excellent anti-sticking properties of ink and can suppress the occurrence of undertrapping when recording surfaces of recording media which each have an ink-receiving layer are overlapped with each other. According to another aspect of the present invention, there can also be provided an ink jet recording apparatus which provides the above described prominent effect.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The present invention will be described in detail below with reference to exemplary embodiments.

Mechanism of Generating Undertrapping

Figure 1A:
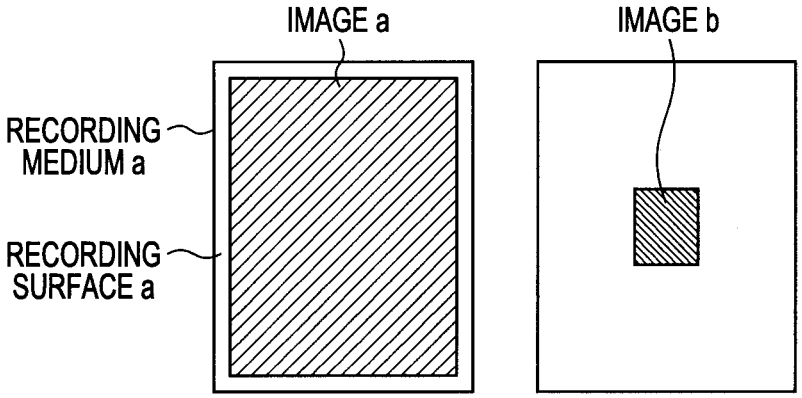
FIGS. 1A and 1B are schematic views illustrating an example of images which cause undertrapping.
Figure 1B:
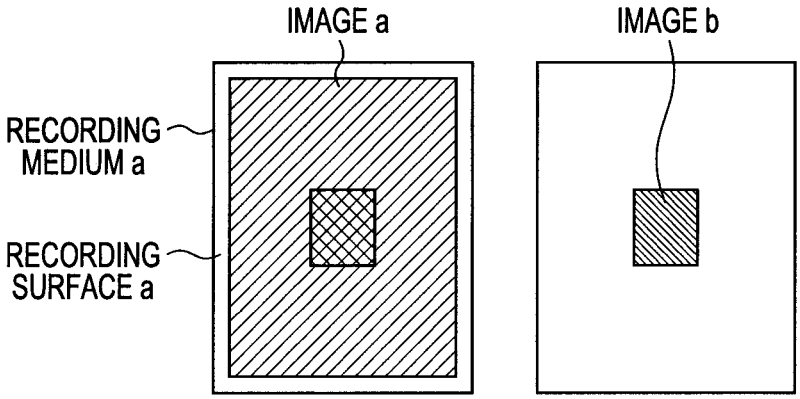

Firstly, a phenomenon of the undertrapping will be described which occurs when recording surfaces of recording media that have an ink-receiving layer are mutually overlapped. Here, in order to facilitate understanding, the case in which the undertrapping particularly remarkably occurs will be taken as an example. As is shown in FIG. 1A, a recording surface a of a recording medium a, on which a black image a is formed on the whole surface, and a recording surface b of a recording medium b, on which a black image b is formed on a part of the region, are overlapped and left for a while. Then, as is shown in FIG. 1B, a white hazy unevenness having a shape of the image b on the recording medium b appears in the region of the image a on the recording medium a. In addition, the white hazy unevenness having a shape of the image a on the recording medium a appears on the recording medium b of FIG. 1B though the figure is not shown, but the degree of the undertrapping is low compared to the undertrapping on the recording medium a, because it is the region of the recording medium b where the image b is not formed.

The present inventors analyzed the reason why the undertrapping as was described in the above occurs. As a result, the present inventors found that the undertrapping occurred according to the following mechanism. Ink used in an ink jet recording method generally includes a liquid component (water, organic compound dissolved in water and organic solvent) other than a coloring material. When an image is formed by using the ink on a recording medium which has an ink-receiving layer, the liquid component contained in the ink does not completely vaporize even when the ink becomes disappeared on the surface of the recording medium after the image has been formed on the recording medium, and remains slightly in the inner part of the ink-receiving layer. After that, the liquid component which remains in the inner part of the ink-receiving layer gradually vaporizes as time passes, but a considerable period of time is needed until the liquid component finishes the vaporization. When a photograph book is produced after an image has been formed, the recording surfaces of the recording medium will usually be overlapped in a state in which the liquid component remains.

At this time, the recording surfaces are overlapped, and accordingly the liquid component which remains in the inner part of the ink-receiving layer of one recording medium occasionally migrates to the ink-receiving layer of the other recording medium. The extent and quantity of the migration depend on the quantity of the liquid component present in the inner part of the ink-receiving layer. Accordingly, when the ink type or the applied quantity differs in the region of the image formed on the recording medium, the quantity of the liquid component which remains in the ink-receiving layer becomes nonuniform, and accordingly when the recording surfaces are overlapped, the quantity of the migration of the liquid component becomes nonuniform. As a result, the quantity of the liquid component present in the inner part of the ink-receiving layer becomes nonuniform according to the regions on the recording medium, and accordingly the haze (turbidness) on the ink-receiving layer differs according to the regions, which is recognized as the undertrapping. In addition, it is considered that the migration of the coloring material does not occur, because the color of the other image was not transferred to the region even when the undertrapping occurred.

Based on this mechanism, the phenomenon which occurs in the previous specific example will be described in more detail. The liquid component originating in the ink is not present in the ink-receiving layer of the region in the recording medium b of FIG. 1A where the image is not formed. Because of this, even when the recording surfaces a and b are overlapped, the migration of the liquid component from the recording medium b to a does not occur in the above described region. On the other hand, the liquid component originating in the ink remains in the ink-receiving layer of the region in the recording medium b of FIG. 1A where the image b is formed. Because of this, when the recording surfaces a and b are overlapped, the liquid component migrates from the recording medium b to a, and the quantities of the liquid components present in the inner parts of the ink-receiving layers become different in the regions in the recording medium a at the positions respectively corresponding to the image region and a non-image region of the recording medium b. As a result, the hazes in the ink-receiving layers also become different, and accordingly the undertrapping comes to be recognized in the recording medium a as the shape of the image b in the recording medium b, as is shown in FIG. 1B.

Process of Having Reached the Present Invention

Then, the present inventors have considered that the occurrence of the undertrapping can be suppressed by decreasing the quantity of the liquid component which remains in the inner part of the ink-receiving layer, and tried to dry the recording medium which had the image formed thereon, after having formed the image, with reference to Japanese Patent Application Laid-Open No. 2000-103044 and Japanese Patent Application Laid-Open No. H11-268256. It was found that the occurrence of the undertrapping is suppressed to a certain extent by such techniques, and that the degree of the suppression also tends to be increased by increasing the quantity of the energy in drying the recording medium, but the degree of the suppression was still insufficient even when a considerable quantity of energy was given. In addition, as a result of having formed an image by humidifying a gap between a recording head and the recording medium with reference to Japanese Patent Application Laid-Open No. 2005-298813, it was found that the clogging resistance was enhanced but the undertrapping tended to more easily occur than the case in which the gap was not humidified.

The present inventors made an investigation on a component which can suppress the migration of the liquid component between recording media even when the liquid component has remained in the inner part of the ink-receiving layer, and as a result, it was found that the occurrence of the undertrapping could be suppressed to a slight extent by using a high-molecular compound such as a resin. However, there was the case in which the ink containing such a high-molecular compound did not show sufficient ejection stability or anti-sticking properties.

Then, the present inventors focused on a compound to be used for ink, and made an investigation on various types of water-soluble organic solvents which satisfy the anti-sticking properties of the ink and can decrease the occurrence of the undertrapping. As a result, it was found that an ink containing bis(2-hydroxyethyl)sulfone was excellent in ejectability such as the anti-sticking properties and could suppress the occurrence of the undertrapping to a certain extent. Then, the present inventors made an investigation also on a compound similar to bis(2-hydroxyethyl)sulfone. Then, it was found that an ink which contained at least one of a compound represented by General Formula (I) and a compound represented by General Formula (II) both of which would be described later not only showed excellent anti-sticking properties but also could suppress the occurrence of the undertrapping better than any of techniques which had been previously investigated. However, the effect was still on a level of not sufficiently suppressing the occurrence of the undertrapping. The compound represented by General Formula (I) and the compound represented by General Formula (II) may be respectively referred to as a compound of General Formula (I) and a compound of General Formula (II) hereinafter.

Then, an image was formed on a recording medium by using an ink containing at least one of the compound of General Formula (I) and the compound of General Formula (II), the recording medium which had the image formed thereon was forcibly dried, and then the state of the recording medium was confirmed. As a result, it was found that an excellent effect of suppressing the undertrapping, which far exceeded the anticipation, could be obtained. Specifically, when the recording medium which had the image formed thereon was dried, the undertrapping was more greatly suppressed than the anticipation, compared to the case in which the recording medium was not dried. In other words, it is important to make the ink contain the above described specific compound and dry the recording medium on which the image has been formed by using the ink, for suppressing the occurrence of the undertrapping and also for satisfying the anti-sticking properties of the ink. On the other hand, when another compound different from the above described specific compound was used for the ink, the undertrapping was suppressed to only a slight extent even when the recording medium which had the image formed thereon was dried, and the effect was still on an insufficient level.

The present inventors also made an investigation on other techniques which can suppress the occurrence of the undertrapping when an ink containing at least one of the compound of General Formula (I) and the compound of General Formula (II) was used. As a result, the present inventors found that the occurrence of the undertrapping could be suppressed also by humidifying the gap between the recording head and the recording medium when forming the image by using the ink containing at least one of the compound of General Formula (I) and the compound of General Formula (II). Specifically, the undertrapping was greatly suppressed when the gap was humidified, compared to the case in which the gap was not humidified. In other words, it is important to make the ink contain the above described specific compound and humidify the gap between the recording head and the recording medium when forming the image by using the ink, for suppressing the occurrence of the undertrapping and also for satisfying the anti-sticking properties of the ink on an excellent level. On the other hand, when another compound different from the above described specific compound was used for the ink, the degree of the undertrapping in the case in which the gap was humidified was occasionally inferior to that in the case in which the gap was not humidified, and the result was still on an insufficient level.

As described above, by a recording method of using an ink containing the specific compound and drying the recording medium on which the image has been formed by using the ink or humidifying the gap between the recording head and the recording medium, the anti-sticking properties of the ink can be satisfied and the occurrence of the undertrapping can be suppressed to an excellent level. Based on the above results, the present inventors made a further investigation, and as a result, found that the occurrence of the undertrapping could be suppressed to an especially high level, by performing both operations of drying the recording medium which had the image formed thereon and humidifying the gap between the recording head and the recording medium. Each embodiment of the present invention will be described respectively in detail below. Incidentally, an image-forming step will be described in the end, because this step is common in each embodiment.

Ink Jet Recording Method

First Embodiment

The feature of the first embodiment according to the present invention is to form an image by using an ink containing at least one of the compound of General Formula (I) and the compound of General Formula (II), and then perform a drying step of drying the recording medium which has the image formed thereon. The present inventors assume a mechanism which can suppress the occurrence of the undertrapping by performing the drying step after the image has been formed by using the ink containing the above described specific compound, in the following way.

To begin with, even though the compound had a structure represented by General Formula (I) or General Formula (II), when an ink containing the compound which was liquid at 25° C. (ordinary temperature) was used, the undertrapping had occurred in either one of the cases of having performed the drying step and not having performed the drying step. Such a compound has a relatively high vapor pressure in a temperature range in which ink jet recording is usually performed, compared to a compound that is used in the present invention and is solid at 25° C., and if the compound remains in the inner part of the ink-receiving layer, the undertrapping occurs because the migration of the compound gradually occurs due to vaporization when the recording surfaces are overlapped. In other words, the compound of General Formula (I) and the compound of General Formula (II) which are used in the present invention belong to such a class that the vapor pressure is relatively low among water-soluble organic compounds that are generally used for the ink, accordingly the migration due to vaporization occurs very little, and the undertrapping can also be suppressed to some extent.

In addition, ethylene urea and trimethylolpropane are solid at 25° C. and belong to such a class that the vapor pressure is relatively low among the water-soluble organic compounds that are generally used for the ink for an ink jet. However, even when the ink containing these compounds was used, the undertrapping had occurred in either one of the cases of having performed the drying step and not having performed the drying step. Thus, the degree of suppressing the undertrapping in the case where the drying step is performed after the image has been formed is completely different between urea or trimethylolpropane and the compound of General Formula (I) or the compound of General Formula (II) which is used in the present invention, though their characteristics are similar in that the vapor pressure is low. The present inventors assume that the reason why there is such difference in the degrees according to the types of the compounds, and why the occurrence of the undertrapping is significantly suppressed by performing the drying step after the image has been formed by using the ink containing the compound of General Formula (I) or General Formula (II), greatly depends on a structure of the compound.

A sulfur atom is contained in structures of the compound of General Formula (I) and the compound of General Formula (II), and when one or two oxygen atoms are bonded to the sulfur atom, the compound possesses polarity. In addition, when the oxygen atom is not bonded to the sulfur atom in the structure of the compound of General Formula (I), a noncovalent electron pair exists in the sulfur atom. Here, the ink jet recording medium having the ink-receiving layer includes an ink-receiving layer which contains a compound having a cationic site for enhancing the fixability of the coloring material or the like. A bond, though being weak, is formed between the cationic site of the compound which constitutes the ink-receiving layer and the polarity or the noncovalent electron pair in the compound of General Formula (I) or the compound of General Formula (II), through a Van der Waals force or the like. It is considered that as a result of this, the compound of General Formula (I) or the compound of General Formula (II) becomes resistant to migration due to vaporization even if having remained in the inner part of the ink-receiving layer, and accordingly can suppress the occurrence of the undertrapping to some extent.

The vaporization of the liquid component is promoted by forcibly drying the recording medium on which an image has been formed by using the above described ink, after the image has been formed. Among the liquid components, most of water vaporizes by drying, but all of water does not completely vaporize and a slight quantity of water remains in the inner part of the ink-receiving layer. In addition, a common water-soluble organic solvent does not completely vaporize in a short period of time even though having been forcibly dried, and remains in the inner part of the ink-receiving layer even after having been dried.

On the other hand, because the vapor pressures of the compound of General Formula (I) and the compound of General Formula (II) are low as described above, the compounds are resistant to vaporization even when having remained in the inner part of the ink-receiving layer. Because of this, an extremely small quantity of water results in existing in the inner part of the ink-receiving layer by forming an image with the use of the ink containing the compound of General Formula (I) or the compound of General Formula (II) and then drying the recording medium which has the image formed thereon. Furthermore, the compound of General Formula (I) and the compound of General Formula (II) are resistant to vaporization though resulting in remaining in the inner part of the ink-receiving layer, and the quantity of other remaining water-soluble organic solvents in the inner part of the ink-receiving layer is reduced by the existence of such a compound in the ink-receiving layer. Therefore, it is considered that the occurrence of the undertrapping due to the migration of the liquid component can be suppressed by the operation of drying the recording medium on which the image has been formed. In other words, the compound of General Formula (I) and the compound of General Formula (II) to be contained in the ink have a common feature of containing a sulfur atom in the structure. This feature is important to obtain the effect of the first embodiment according to the present invention by drying a recording medium on which the image has been formed by using the above described ink.

In the drying step, the liquid component which has been applied to the recording medium and has originated from the ink is required to be vaporized, and the method therefor includes, for instance, blowing of hot air and irradiation with infrared rays or ultraviolet rays. In the present invention, the drying step can particularly be performed by allowing a hot air having a temperature of 50° C. or higher to blow against the recording medium which has the image formed thereon, for two seconds or longer. Thereby, the liquid components which remain in the inner part of the ink-receiving layer are efficiently vaporized, accordingly an extremely small quantity of water results in remaining in the inner part of the ink-receiving layer of the recording medium after the drying step, and accordingly the occurrence of the undertrapping can be more effectively suppressed. It is preferable that the upper limit of the temperature of the hot air is 95° C. or lower, and the upper limit of the period of time for blowing is 10 seconds or shorter.

Second Embodiment

The feature of the second embodiment according to the present invention is to perform a humidifying step of humidifying a gap between a recording head and a recording medium when forming an image by using an ink containing at least one of the compound of General Formula (I) and the compound of General Formula (II). The present inventors assume the mechanism which can suppress the occurrence of the undertrapping by performing the humidifying step when forming the image by using the ink containing the above described specific compound, in the following way.

Figure 2A:
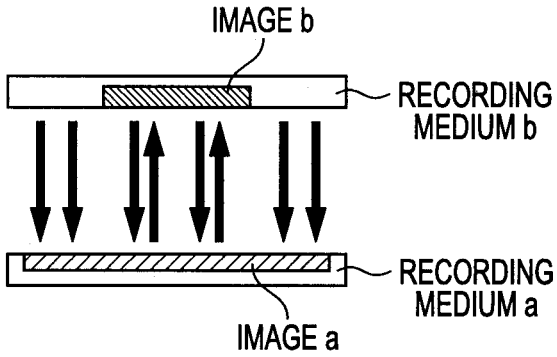
FIGS. 2A and 2B are schematic views illustrating a mechanism in which undertrapping is suppressed by humidification.
Figure 2B:
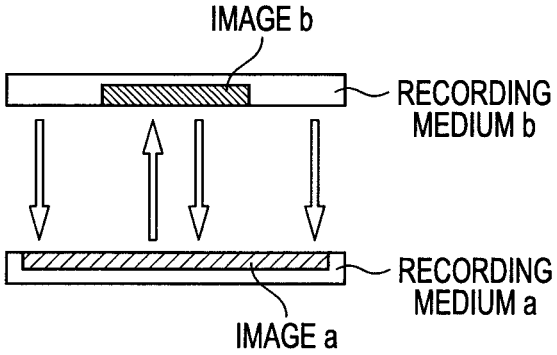

The compound of General Formula (I) and the compound of General Formula (II) contain a sulfur atom in the structure, and accordingly have high compatibility with water or other water-soluble organic solvents (liquid components) in ink. The mechanism which can suppress the occurrence of the undertrapping by performing humidification will be described below, taking the case in which two types of images a and b as illustrated in the above described FIGS. 1A and 1B are formed, as an example. Here, FIGS. 2A and 2B illustrate sectional views of overlapped recording surfaces a and b of recording media a and b in which such images a and b have been formed respectively, in which FIG. 2A illustrates the case in which the recording media have not been humidified, and FIG. 2B illustrates the case in which the recording media have been humidified. Incidentally, FIGS. 2A and 2B illustrate the recording media a and b in the state in which the recording surfaces a and b are not contacted, in order to facilitate description.

First, the case shall be considered in which the images a and b are formed in the recording media a and b respectively when a gap between a recording head and the recording medium is not humidified. Because the gap between the recording head and the recording medium is not humidified when the image is formed, the compound of General Formula (I) and the compound of General Formula (II) present in the ink-receiving layer of the region of the images a and b are in the state of not fully absorbing water during the time period between the beginning of image formation and right after the image formation. Therefore, the ink-receiving layer in the region of the images a and b is in the state of being very easy to absorb a liquid component. Because of this, as illustrated in FIG. 2A, liquid components migrate from the region other than that of the image b on recording medium b to the region of the image a on the recording medium a, in most cases. On the other hand, liquid components also migrate from the region of the image b to the region of the image a and also from the region of the image a to the region of the image b. However, the quantity of the liquid components which migrate from the image b to the image a is equivalent to the quantity of the liquid components from the image a to the image b, and accordingly it may be considered that the liquid components do not migrate apparently. In other words, in a region in which the image b has been overlapped and the other region within the region of the image a, there are apparently a region in which the migration of the liquid components occur and a region in which the migration of the liquid components does not occur. It is considered that the quantities of the liquid components presents in the inner part of the ink-receiving layer are different between these regions, which is recognized as a difference of the haze to cause the undertrapping.

Next, the case shall be considered in which the images a and b are formed in the recording media a and b respectively when the gap between the recording head and the recording medium is humidified. Because the gap between the recording head and the recording medium is humidified when the image is formed, the compound of General Formula (I) and the compound of General Formula (II) present in the inner part of in the ink-receiving layer in the regions of the images a and b are in the state of fully absorbing moisture in the atmosphere, due to its water absorbing properties. Accordingly, the water absorbing properties of the compound of General Formula (I) and the compound of General Formula (II) present in the inner part of the ink-receiving layer in the regions of the images a and b are lower than those in the images a and b formed when the gap is not humidified. Because of this, when the gap is humidified, the liquid components migrate little from the region other than that of the image b on the recording medium b to the region of the image a as illustrated in FIG. 2B, and it is considered that the liquid components do not migrate substantially. Similarly, the liquid components migrate little also from the region of the image a to the region of the image b. In other words, it is considered that the quantities of liquid components which are generated by the migration of the liquid components and are consequently present in the inner part of the ink-receiving layer become equivalent in the region in which the image b was overlapped and the other region within the region of the image a, and that there is also a little difference between the hazes, so that the occurrence of the undertrapping is considered to be suppressed.

In the humidifying step, the state may be generated in which the ink-receiving layer of the recording medium fully absorbs moisture and the compound of General Formula (I) and the compound of General Formula (II) absorb water. The method therefor includes, for instance, a method of supplying humidified air into the gap between the recording head and the recording medium. In the present invention, the humidifying step can be performed by supplying humidified air into the gap between the recording head and the recording medium, on the condition of setting the atmosphere of the gap between the recording head and the recording medium at a temperature of 35° C. or lower and an absolute humidity of 0.013 kg/kgDA or higher. The lower limit of the temperature can be 25° C. or higher. The relative humidity is preferably less than 100%, which is a prerequisite for the above conditions.

Third Embodiment

It has been described so far that the occurrence of the undertrapping can be suppressed by forming an image with the use of the ink containing at least one of the compound of General Formula (I) and the compound of General Formula (II) and by performing at least one of the drying step and the humidifying step. As is clearly shown in the above described mechanism, the occurrence of the undertrapping can be suppressed to a better level in the third embodiment of the present invention, in which both of these steps are performed.

By performing the humidifying step when forming the image, the compound of General Formula (I) and the compound of General Formula (II) absorb water, and thereby water present in the ink-receiving layer in the region of the image formed by the ink. In addition, the difference between hazes is reduced by the previously described mechanism, and accordingly the occurrence of the undertrapping is suppressed. Furthermore, by drying the recording medium which has the image formed thereon, after the image is formed while performing the above described humidifying step, an extremely small quantity of the liquid components results in remaining in the inner part of the ink-receiving layer. Here, by the presence of the compound of General Formula (I) or the compound of General Formula (II) which has remained, the quantity of other remaining water-soluble organic solvents in the inner part of the ink-receiving layer are reduced, and accordingly, the occurrence of the undertrapping can be more effectively suppressed.

In other words, in the second embodiment in which the humidifying step is performed, the occurrence of the undertrapping is suppressed by the water absorption properties of the compound of General Formula (I) and the compound of General Formula (II) present in the inner part of the ink-receiving layer of the recording medium during the time period between the beginning of image formation and right after the image formation. In addition, the first embodiment which performs the drying step focuses attention on the state after the time period in which the mechanism of suppressing the occurrence of the undertrapping by the second embodiment works. Specifically, when an extremely small quantity of water results in remaining in the inner part of the ink-receiving layer in the recording medium due to drying, the occurrence of the undertrapping is suppressed by the interaction of the compound of General Formula (I) or the compound of General Formula (II) with the ink-receiving layer. In each of these embodiments, the timings at which the mechanisms of the undertrapping suppression work do not overlap, accordingly the embodiments do not contradict each other, and the third embodiment which performs both of these embodiments can acquire the effect of suppressing the undertrapping on a higher level.

Pre-Humidifying Step

In the present invention, it is possible to further perform the pre-humidifying step which humidifies the recording medium before the image is formed, in addition to each step performed in the above described each embodiment. In this step, the recording medium is humidified before the recording medium advances into the image-forming position including the recording heads. By performing this pre-humidifying step, the recording medium is converted into the state of having fully absorbed water beforehand, before the image is formed thereon. Because of this, the water absorption properties of the compound of General Formula (I) and the compound of General Formula (II) present in the inner part of the ink-receiving layer of the recording medium after the image formation is further decreased, and the occurrence of the undertrapping can be remarkably suppressed. In the present invention, in the pre-humidifying step, humidified air can be supplied to the recording medium before the recording medium advances into the image-forming position including the recording heads, under conditions of an atmosphere with a temperature of 35° C. or lower and an absolute humidity of 0.013 kg/kgDA or higher.

Image-Forming Step

In each of the above described embodiments according to the present invention, the image is formed by ejecting an ink from the ink jet recording head to form an image on a recording medium having an ink-receiving layer. The ink to be used for forming the image is required to contain at least one of the compound of General Formula (I) and the compound of General Formula (II). A system for ejecting the ink includes a method of applying thermal energy or mechanical energy to the ink, and in the present invention, the system for ejecting the ink by the action of the thermal energy can be used in particular.

Recording Medium:

A recording medium to be used in the present invention may be any recording medium as long as the recording medium has an ink-receiving layer, and preferably has the surface having glossy or semigloss properties. Specifically, it is preferable to use a recording medium which has an ink-receiving layer that includes pigments such as silica, alumina and a hydrate thereof as main components, and additives such as a binder and a cationic polymer as needed, on at least one face of a support. Such a recording medium absorbs ink in voids in a porous structure including pigment particles, and is suitable because an image formed thereon has high quality.

The support can be made of a material which can have the ink-receiving layer formed thereon and gives such stiffness that the support can be conveyed by a conveying mechanism in the ink jet recording apparatus, and includes, for instance, a paper which contains pulp and fillers. In addition, the recording medium may be a recording medium in which a support has a resin layer of a polyolefin or the like provided on at least one face thereof and further has an ink-receiving layer formed thereon. Furthermore, the recording medium can also be used which has the ink-receiving layer on both faces of the support.

In addition, the recording medium to be used for the ink jet recording method according to the present invention may be a recording medium which has been cut into a desired size beforehand, or a recording medium which is initially a sheet wound into a roll form and is cut into a desired size after an image has been formed thereon.

Ink:

Compound Represented by General Formula (I) and Compound Represented by General Formula (II)

The ink to be used for forming the image of the present invention contains at least one of a compound represented by the following General Formula (I) and a compound represented by the following General Formula (II). These compounds need to be solid at 25° C. The content (mass %) of the compound represented by General Formula (I) and the compound represented by General Formula (II) in the ink is preferably 2.0 mass % or more and 20.0 mass % or less with respect to the total mass of the ink. If the content is less than 2.0 mass %, the occurrence of the undertrapping may not be sufficiently suppressed, and if the content is more than 20.0 mass %, the anti-sticking properties of the ink may not be sufficiently obtained.

$$R_1 \text{—} R_3 \text{—} R_2 \quad \text{(I)}$$

(The compound represented by General Formula (I) is solid at 25° C.; $R_1$ and $R_2$ are each independently a hydrogen atom, a hydroxy group, a substituted or unsubstituted amino group, a substituted or unsubstituted alkoxy group, a substituted or unsubstituted aminooxy group, a substituted or unsubstituted alkyl group, a substituted or unsubstituted alkenyl group, a substituted or unsubstituted alkynyl group, a substituted or unsubstituted aralkyl group, a substituted or unsubstituted aryl group, or a substituted or unsubstituted heterocycle; and $R_3$ is one of —S—, —S(=O)— and —S(=O)$_2$—.)

(II)

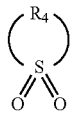

(The compound represented by General Formula (II) is solid at 25° C.; and $R_4$ is a molecular chain which constitutes a heterocycle together with a sulfur atom.)

$R_1$ and $R_2$ in General Formula (I) are each independently a hydrogen atom, a hydroxy group, a substituted or unsubstituted amino group, a substituted or unsubstituted alkoxy group, a substituted or unsubstituted aminooxy group, a substituted or unsubstituted alkyl group, a substituted or unsubstituted alkenyl group, a substituted or unsubstituted alkynyl group, a substituted or unsubstituted aryl group, a substituted or unsubstituted aralkyl group, or a substituted or unsubstituted heterocyclic group. When these groups have a substituent, the substituent includes a hydroxy group, an alkyl group, an alkenyl group, an alkynyl group, an aryl group, an aralkyl group, a heterocyclic group, an acyl group, a carbamoyl group, an amino group, an amide group, an aminooxy group, an alkoxy group, a carboxy group, a sulfonyl group, and at least one selected from the group consisting of substituents formed by combining at least two of the substituents thereof.

In the present invention, the compound represented by General Formula (I) is solid at 25° C. Accordingly, the compound does not include at least the compounds in which both $R_1$ and $R_2$ are hydrogen atoms, in which both $R_1$ and $R_2$ are hydroxy groups, and in which one of $R_1$ and $R_2$ is a hydrogen atom and the other is a hydroxy group, in General Formula (I).

$R_4$ in General Formula (II) is a molecular chain which constitutes a heterocycle together with a sulfur atom. Specifically, $R_4$ includes an alkylene group, in which the hydrocarbon chain that constitutes an alkylene chain may be discontinued in the middle by another atom (for instance, an oxygen atom, a sulfur atom and a nitrogen atom). In addition, the alkylene group may have a substituent, and the substituent in this case can include the above-listed substituents for $R_1$ and $R_2$.

In the present invention, when $R_1$ to $R_4$ are groups containing a carbon atom, $R_1$ to $R_4$ are preferably groups which each independently have 1 to 12 carbon atoms, from a viewpoint of the solubility of the compound represented by General Formula (I) or General Formula (II) into an aqueous medium. In addition, the substituent may have a hydrophilic group such as a hydroxy group and a carboxy group, for the same reason.

Specific examples of the compound represented by General Formula (I) and the compound represented by General Formula (II) can include the following compounds. Of course, the compound specified in the present invention is not limited to the following compounds, as long as the compounds are included in the structure and the definition of General Formula (I) or General Formula (II).

bis(2-hydroxyethyl)sulfone

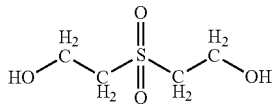

bis(2-hydroxyethyl)sulfoxide

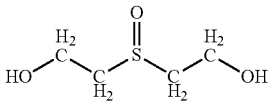

2,2'-thioglycolic acid

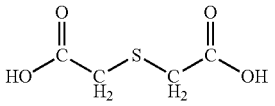

1,3-bis(2-hydroxyethylsulfonyl)-2-propyl

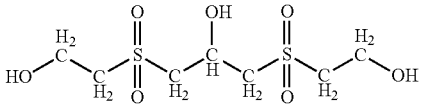

4-(2-hydroxyethyl)thiomorpholine-1,1-dioxide

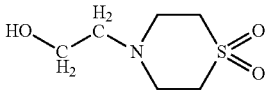

In the present invention, it is preferable that $R_1$ and $R_2$ in General Formula (I) are each independently a hydroxyalkyl group, and is further preferable that both $R_1$ and $R_2$ are a hydroxyethyl group. The compound represented by General Formula (I) can particularly be bis(2-hydroxyethyl)sulfone.

Aqueous Medium

The ink can contain an aqueous medium which is a mixed solvent of water and a water-soluble organic solvent, in addition to at least one of the compound represented by General Formula (I) and the compound represented by General Formula (II). As for the water, it is preferable to use deionized water or ion-exchange water. The water content (mass %) in the ink is preferably 50.0 mass % or more and 95.0 mass % or less with respect to the total mass of the ink. A water-soluble organic solvent which can be used in the ink for the ink jet system includes monovalent or polyvalent alcohols, glycols, glycol ethers and nitrogen-containing compounds, and the ink can contain one or more types thereof. In the present invention, it is preferable to use at least one of water-soluble organic solvents having a higher vapor pressure than that of water at 25° C., because the solvents are superior in moisture retention and can improve anti-sticking properties of the ink. The content of the water-soluble organic solvent (mass %) in the ink is preferably 2.0 mass % or more and 50.0 mass % or less with respect to the total mass of ink. The content of the water-soluble organic solvent in this case shall contain the content of at least one of the compound represented by General Formula (I) and the compound represented by General Formula (II).

Coloring Material

A coloring material which is contained in the ink includes pigment such as dye, organic pigment and inorganic pigment, and can be used singly or in combinations of one or more types. The content of the coloring material in the ink is preferably 0.1 mass % or more and 10.0 mass % or less, and more preferably 0.3 mass % or more and 8.0 mass % or less, with reference to the total mass of the ink. A usable hue of the coloring material includes black, cyan, magenta, yellow, red, green and blue.

In the present invention, it is particularly preferable to use dyes as the coloring material, because dies can easily attain a high level of quality of a formed image comparable to that of a silver salt photograph. It is possible to use a dye which has water solubility by having an anionic group therein such as a sulfonic group and a carboxyl group, and specifically includes an acid dye, a direct dye and a reactive dye which are described in the color index (COLOUR INDEX). In addition, even if the dye is not described in the color index, any types of the dye can be used as long as the dye has at least an anionic group such as the sulfonic group and the carboxyl group.

Other Additives

The ink to be used in the present invention may include a water-soluble organic compound which is solid at room temperature, such as urea, a derivative thereof and polyhydric alcohols like trimethylolpropane and trimethylolethane. In addition, the ink may include various types of additives such as a surface active agent, a pH adjuster, a rust preventive agent, an antiseptic agent, a mildew proofing agent, an antioxidant, a reduction-preventing agent, a vaporization accelerator, a chelating agent and a water-soluble polymer, in addition to the above described components, as needed.

<Ink Jet Recording Apparatus>

An ink jet recording apparatus according to the present invention has an ink storage portion for storing an ink therein, and an image forming portion for forming an image on a recording medium having an ink-receiving layer by ejecting the ink from an ink jet recording head. The ink jet recording apparatus further has at least one of a unit for drying the recording medium which has the above described image formed thereon and a unit for humidifying the gap between the above described recording head and the above described recording medium, wherein the above described ink is stored in the ink storage portion.

Figure 3:
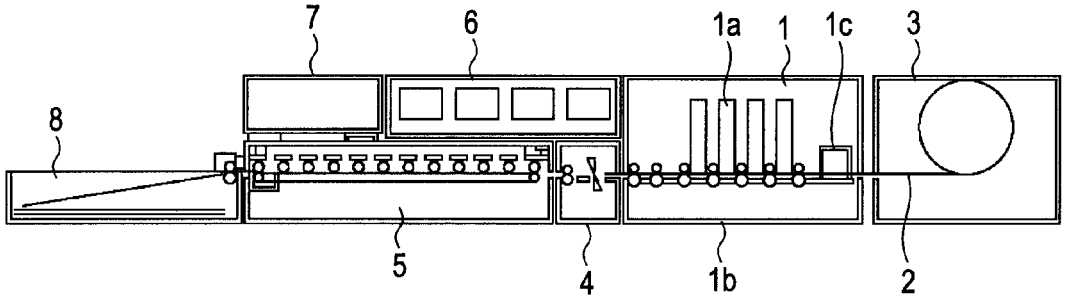
FIG. 3 is a sectional view illustrating the whole configuration of an ink jet recording apparatus.

The configuration of the ink jet recording apparatus according to the present invention will be described below. FIG. 3 is a sectional view illustrating one example of the whole configuration of an ink jet recording apparatus for performing an ink jet recording method according to the first embodiment of the present invention. The recording apparatus includes a paper feeding portion 3, an image forming portion 1, a cutting portion 4, a drying portion 5, an ink storage portion 6, a controlling portion 7, a paper-ejecting portion 8, along a conveying direction for the recording medium from the upstream side toward the downstream side. The paper feeding portion 3 rotatably holds the recording medium 2 which is wound into a roll form. The image forming portion 1 has a plurality of recording heads 1*a* which correspond to different ink colors, respectively. Here, the image forming portion 1 is provided in a form of having four recording heads corresponding to four types of the ink, but the number of the inks is not limited to four. The inks are supplied to the recording heads 1*a* respectively from the ink storage portions 6 through ink tubes (un-illustrated). Each of the plurality of the recording heads 1*a* is a line type of recording head, in which a nozzle row of an ink jet system is formed in such a range as to cover the maximum width of the recording medium which is expected to be used.

In an image forming portion 1, a recording medium conveying passage crosses so as to face the recording heads 1*a*, and a recording medium conveying mechanism is provided along the recording medium conveying passage. The plurality of the recording heads 1*a* and the conveying mechanism are stored in a substantially closed space in a housing 1*b*. In an upstream side of the recording head 1*a* in the conveying direction, the first humidifying portion 1*c* is provided which pre-humidifies the recording medium before the recording medium advances into an image-forming position including the recording heads.

The cutting portion 4 is a unit for cutting the recording medium which has initially a rolled paper form and has an image formed thereon in an image forming portion 1, into a predetermined size, and is provided with a cutting mechanism. The drying portion 5 is a unit for drying a cut recording medium in a short period of time, and is provided with a hot air device including a heater for heating a gas and a fan for generating a flow of a heated gas (unshown), and a plurality of conveying rollers which are arrayed along the conveying passage of the recording medium. The paper-ejecting portion 8 is a unit for storing the cut recording medium discharged from the drying portion 5, and a plurality of recording media are sequentially stacked therein. The controlling portion 7 is a controller for managing various controls and drive of the whole recording apparatus.

Figure 4:
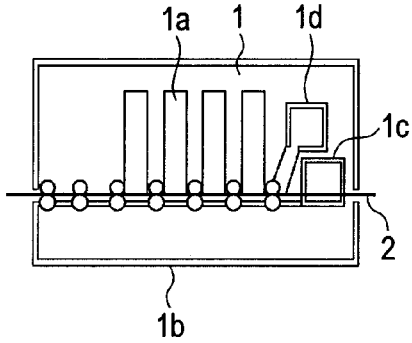
FIG. 4 is a schematic view illustrating the main part of the ink jet recording apparatus.

FIG. 4 is a schematic view illustrating one example of the main part of the ink jet recording, apparatus for performing the ink jet recording method according to the second embodiment of the present invention, which has another configuration of the above described image forming portion 1. The part which is different from the above described ink jet recording apparatus in the first embodiment will be described below. The image forming portion 1 in the present configuration has a second humidifying portion 1*d* for humidifying the gap between the recording head 1*a* and the recording medium provided therein, and the humidifying portion 1*d* supplies humidified air between the recording head 1*a* and the recording medium (so-called paper-head distance). This humidified air may be adjusted so as to be supplied not only into the gap between the recording head 1*a* and the recording medium but also to the overall space of the substantially closed space in the housing 1*b*, and so as to control the temperature and humidity in the overall space to a desired atmosphere. The ink jet recording apparatus according to the second embodiment of the present invention may not have the drying portion 5.

The ink jet recording apparatus for performing the ink jet recording method according to the third embodiment of the present invention may substitute the image forming portion illustrated in FIG. 4 for the image forming portion in the whole configuration illustrated in FIG. 3.

Incidentally, depending on the surrounding environment of the place in which the ink jet recording apparatus is installed, it may become such conditions of the temperature and humidity as to be set in the above described drying step or humidifying step. However, the temperature and humidity of the outside environment are always changing, and accordingly the conditions of the desired temperature and humidity may not always be satisfied. Accordingly, it is unchangeably useful for stably obtaining the effect of the present invention to perform the drying step and the humidifying step in order to control the atmosphere to such conditions of the temperature and humidity as to be set in the present invention.

EXAMPLES

The present invention will be described further in detail below with reference to Examples and Comparative Examples, but the present invention is not limited by the following Examples unless going beyond the gist of the invention.

<Preparation of Ink>

Each ink was prepared by mixing the respective components shown in the following Table 1 (unit: mass %), dissolving the components while sufficiently stirring the mixture, and pressure-filtering the solution with a filter having a pore size of 0.2 μm. Incidentally, Acetylenol E100 is a nonionic surface active agent made by Kawaken Fine Chemicals Co., Ltd. In addition, a used dye was a compound obtained by converting the compound No. 17 described in International Publication No. WO 2007/077931 into a sodium salt type. The dye has the following structure.

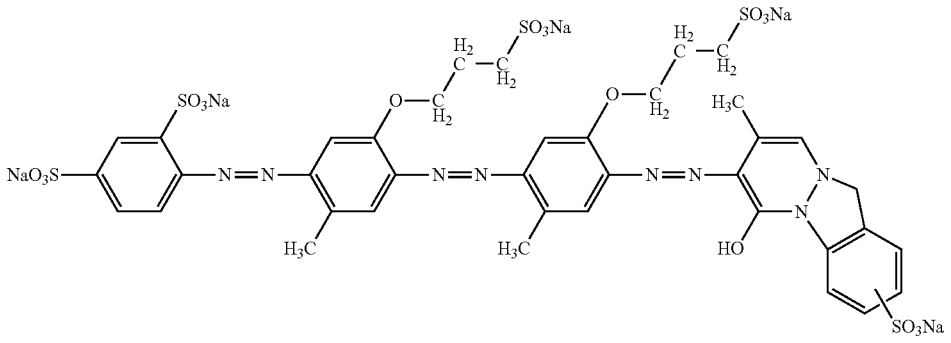

TABLE 1

| Composition of ink | | | | | | | | | | | | | |
|---|---|---|---|---|---|---|---|---|---|---|---|---|---|
| | Number of ink | | | | | | | | | | | | |
| | 1 | 2 | 3 | 4 | 5 | 6 | 7 | 8 | 9 | 10 | 11 | 12 | 13 |
| Coloring material | 3.0 | 3.0 | 3.0 | 3.0 | 3.0 | 3.0 | 3.0 | 3.0 | 3.0 | 3.0 | 3.0 | 3.0 | 3.0 |
| Glycerine | 2.0 | 2.0 | 2.0 | 2.0 | 2.0 | 2.0 | 2.0 | 2.0 | 2.0 | 12.0 | 2.0 | 2.0 | 2.0 |
| Bis(2-hydroxyethyl)sulfone | 10.0 | | | | | 1.0 | 2.0 | 20.0 | 21.0 | | | | |
| Bis(2-hydroxyethyl)sulfoxide | | 10.0 | | | | | | | | | | | |
| 2,2'-thioglycolic acid | | | 10.0 | | | | | | | | | | |
| 1,3-bis(2-hydroxyethylsulfonyl)-2-propyl | | | | 10.0 | | | | | | | | | |
| 4-(2-hydroxyethyl)thiomorpholine-1,1-dioxide | | | | | 10.0 | | | | | | | | |
| Ethylene urea | | | | | | | | | | | 10.0 | | |
| 2-pyrrolidone | | | | | | | | | | | | 10.0 | |
| Thiodiglycol | | | | | | | | | | | | | 10.0 |
| Acetylenol E100 | 0.4 | 0.4 | 0.4 | 0.4 | 0.4 | 0.4 | 0.4 | 0.4 | 0.4 | 0.4 | 0.4 | 0.4 | 0.4 |
| Water | 84.6 | 84.6 | 84.6 | 84.6 | 84.6 | 93.6 | 92.6 | 74.6 | 73.6 | 84.6 | 84.6 | 84.6 | 84.6 |

<Evaluation>

Each embodiment according to the present invention was evaluated below. In the evaluation criteria for each evaluation item in the present invention, AA, A and B are of an acceptable level, and C is of an unacceptable level.

First Embodiment

Suppression of Undertrapping

Two types of images a and b in FIG. 1A were formed on recording media (trade name: Canon Photo Paper Gloss Gold GL-101: made by Canon Inc.) which have an ink-receiving layer thereon, by using various types of inks shown in the following Table 2, with a recording duty set at 100%. Subsequently to the formation of the image, hot air was allowed to blow against the recording media which had the image formed thereon, on the conditions of the temperature and the period of time shown in Table 2 to dry the recording media. The used ink jet recording apparatus is an apparatus having a configuration illustrated in FIG. 3. Specifically, it is an apparatus that has a first humidifying portion which performs humidification before a recording medium advances into an image forming portion, a recording head which ejects an ink by the action of thermal energy, and a drying portion which dries the recording medium that has an image formed thereon. Incidentally, when pre-humidification is not performed, the first humidifying portion may not be provided. As for the recording condition, the volume per one droplet of ink was set at 2.8 pL, and the resolution was set at 2,400 dpi×1,200 dpi. In the present invention, the image with the recording duty of 100% was determined to be an image that was formed on the condition of applying eight droplets of the ink of which the volume per one droplet is 2.8 pL, to a unit region of 1/600 inch×1/600 inch. After that, the images a and b were left in an environment having a temperature of 23° C. and a relative humidity of 50%, for 30 minutes, then the recording surfaces a and b were overlapped, a weight which has a comparable size to the recording media and has a contact pressure of 13 kg/m$^2$ was placed on the overlapped recording surfaces, the resultant recording surfaces were left for 24 hours, and evaluation samples were obtained.

In the evaluation samples obtained in the above description, the regions in a recording medium a at the positions respectively corresponding to an image region and a non-image region in the overlapped recording medium b were respectively taken to be a region 1 and a region 2. Then, L*, a* and b* were measured on the region 1 and the region 2 by using a spectrophotometer (Spectrolino; made by Gretag Macbeth Co.) on such conditions that a light-source was D50 and a view angle was 2°. From the $L_1$*, $a_1$*, $b_1$* in the region 1 and the $L_2$*, $a_2$*, $b_2$* in the region 2, the value ΔE was calculated based on the formula; $\Delta E=\{(L_1^*-L_2^*)^2+(a_1^*-a_2^*)^2+(b_1^*-b_2^*)^2\}^{1/2}$, and the effect of suppressing the undertrapping was evaluated from the value ΔE. The evaluation criteria are as follows. The results are shown in Table 2.

AA: ΔE was 0.3 or less and the undertrapping could not be confirmed by visual observation.

A: ΔE was more than 0.3 and 0.5 or less, and almost no undertrapping could be confirmed by visual observation.

B: ΔE was more than 0.5 and 0.6 or less, and the undertrapping could be slightly confirmed by visual observation.

C: ΔE was more than 0.6 and the undertrapping was clearly confirmed by visual observation.

Lowering Rate of Undertrapping by Drying:

The value ΔE measured on the above described evaluation sample (which was dried) was taken to be $\Delta E_1$, and the value ΔE obtained by producing an evaluation sample in the same way except that the sample was not dried, and then calculating the value on the obtained image in the same way as that described above was taken to be $\Delta E_2$. Then, the reduction rate of the undertrapping by drying was evaluated from the value of the reduction rate (%) which was calculated based on the expression: reduction rate (%)=$100-\Delta E_1/\Delta E_2*100$. The evaluation criteria are as follow. The results are shown in Table 2.

A: Reduction was 60% or more.

B: Reduction rate was 40% or more and less than 60%.

C: Reduction rate was less than 40%.

Anti-Sticking Property:

The nozzle check pattern of PIXUS iP8600 was recorded by using various types of inks shown in the following Table 2 after having performed a recovery operation (cleaning) beforehand on an ink jet recording apparatus (trade name: PIXUS iP8600). Then, the recording heads were set in a state of not being capped, by unplugging a power cable of the recording apparatus while the carriage was working, and under this state, the ink jet recording apparatus was left in an environment at a temperature of 30° C. and with a relative humidity of 10%, for 14 days. After that, the ink jet recording apparatus was left in an environment at a temperature of 25° C. for 6 hours, then was returned to an environment at room temperature, and the anti-sticking properties were evaluated by performing recording while performing a recovery operation. The evaluation criteria are as follow.

The results are shown in Table 2.

A: Recording could be normally performed after 1 to 2 times of recovery operations.

B: Recording could be normally performed after 3 to 10 times of recovery operations.

C: Recording could not be normally performed by 10 times or less of recovery operations.

TABLE 2

Evaluation conditions and results of first embodiment

| | | Evaluation condition | | | | Evaluation result | | |
|---|---|---|---|---|---|---|---|---|
| | | Ink number | Temperature of hot air [° C.] | Time period for hot air blowing [second] | Pre-humidifying step | Suppression of under-trapping | Reduction rate of under-trapping | Anti-sticking property |
| Example | I-1 | 1 | 70 | 10 | Not conducted | A | A | A |
| | I-2 | 2 | 70 | 10 | Not conducted | A | A | A |
| | I-3 | 3 | 70 | 10 | Not conducted | A | A | A |
| | I-4 | 4 | 70 | 10 | Not conducted | A | A | A |
| | I-5 | 5 | 70 | 10 | Not conducted | A | A | A |
| | I-6 | 6 | 70 | 10 | Not conducted | A | A | A |
| | I-7 | 7 | 70 | 10 | Not conducted | A | A | A |
| | I-8 | 8 | 70 | 10 | Not conducted | A | A | A |
| | I-9 | 9 | 70 | 10 | Not conducted | A | A | B |
| | I-10 | 1 | 70 | 10 | Conducted | A | A | A |
| | I-11 | 1 | 50 | 10 | Not conducted | A | A | A |
| | I-12 | 1 | 49 | 10 | Not conducted | A | A | A |
| | I-13 | 1 | 70 | 2 | Not conducted | A | A | A |
| | I-14 | 1 | 70 | 1 | Not conducted | A | A | A |
| Comparative Example | I-1 | 1 | Not conducted | | Not conducted | C | — | A |
| | I-2 | 10 | 70 | 10 | Not conducted | C | C | A |
| | I-3 | 11 | 70 | 10 | Not conducted | C | C | B |
| | I-4 | 12 | 70 | 10 | Not conducted | C | C | A |
| | I-5 | 13 | 70 | 10 | Not conducted | C | C | A |

Incidentally, the suppression of the undertrapping and the reduction rate of the undertrapping by drying in Examples I-6, 12 and 14 were all evaluated to be rank A, but were slightly inferior to the other Examples which were evaluated to be rank A. In addition, the suppression of the undertrapping in Example I-10 was superior to the other Examples which were evaluated to be rank A.

Second Embodiment

Suppression of Undertrapping

Two types of images a and b in FIG. 1A were formed on recording media (trade name: Canon Photo Paper Gloss Gold GL-101: made by Canon, Inc.) which have an ink-receiving layer thereon, by using various types of inks shown in the following Table 3, with a recording duty set at 100%. At this time, a humidified air was supplied to control the atmosphere between the recording head and the recording medium to the conditions of the temperature and the relative humidity shown in Table 3. The used ink jet recording apparatus is an apparatus in which the image forming portion in FIG. 3 was replaced with the configuration illustrated in FIG. 4. Specifically, the ink jet recording apparatus is an apparatus that has a first humidifying portion which performs humidification before the recording medium advances into an image forming portion, the recording head which ejects an ink by the action of thermal energy, and a second humidifying portion which supplies a humidified air into a gap between the recording head and the recording medium when forming an image. Incidentally, when the pre-humidification is not performed, the first humidifying portion may not be provided, and because the drying step is not performed in the present embodiment, the drying portion illustrated in FIG. 3 may not be provided. An evaluation sample was produced in the same way as that in the first embodiment except for the above-described condition, and the suppression of the undertrapping was evaluated according to the same evaluation criteria. The results are shown in Table 3.

Reduction Rate of Undertrapping by Humidification:

The value $\Delta E$ measured on the above described evaluation sample (which was humidified) was taken to be $\Delta E_1$, and the value $\Delta E$ obtained by producing an evaluation sample in the same way except that the sample was not subjected to humidification (including pre-humidification), and then calculating the value on the obtained image in the same way was taken to be $\Delta E_2$. Then, the lowering rate for the undertrapping by humidification was evaluated from the value of the reduction rate (%) which was calculated based on the expression: reduction rate (%)$=100-\Delta E_1/\Delta E_2*100$. The evaluation criteria are as follow. The results are shown in Table 3.

A: Reduction rate was 30% or more.

B: Reduction rate was 0% or more and less than 30%.

C: Reduction rate was less than 0% (the degree of undertrapping became worse by humidification).

Anti-Sticking Property:

Anti-sticking properties were evaluated according to the same procedure and evaluation criteria to those in the first embodiment except that various types of inks shown in the following Table 3 were used. The results are shown in Table 3.

TABLE 3 evaluation conditions and results of second embodiment

| | | Evaluation condition | | | | Evaluation result | | |
|---|---|---|---|---|---|---|---|---|
| | | Ink number | Humidification temperature [° C.] | Absolute humidity [kg/kgDA] | Pre-humidifying step | Suppression of under-trapping | Reduction rate of under-trapping | Anti-sticking property |
| Example | II-1 | 1 | 35 | 0.015 | Not conducted | A | A | A |
| | II-2 | 2 | 35 | 0.015 | Not conducted | A | A | A |
| | II-3 | 3 | 35 | 0.015 | Not conducted | A | A | A |
| | II-4 | 4 | 35 | 0.015 | Not conducted | A | A | A |
| | II-5 | 5 | 35 | 0.015 | Not conducted | A | A | A |
| | II-6 | 6 | 35 | 0.015 | Not conducted | A | A | A |
| | II-7 | 7 | 35 | 0.015 | Not conducted | A | A | A |
| | II-8 | 8 | 35 | 0.015 | Not conducted | A | A | A |
| | II-9 | 9 | 35 | 0.015 | Not conducted | A | A | B |
| | II-10 | 1 | 35 | 0.015 | Conducted | A | A | A |
| | II-11 | 1 | 35 | 0.013 | Not conducted | A | A | A |
| | II-12 | 1 | 35 | 0.010 | Not conducted | A | A | A |
| | II-13 | 1 | 37 | 0.013 | Not conducted | A | A | A |
| Comparative Example | II-1 | 1 | Not conducted | | Not conducted | C | — | A |
| | II-2 | 10 | 35 | 0.013 | Not conducted | C | C | A |
| | II-3 | 11 | 35 | 0.013 | Not conducted | C | C | B |
| | II-4 | 12 | 35 | 0.013 | Not conducted | C | C | A |
| | II-5 | 13 | 35 | 0.013 | Not conducted | C | C | A |

Incidentally, the suppression of the undertrapping in Examples II-6, 12 and 13 were all evaluated to be rank A, but were slightly inferior to the other Examples which were evaluated to be rank A, and the suppression of the undertrapping in Example II-10 was superior to the other Examples which were evaluated to be rank A. In addition, the reduction rates of the undertrapping by humidification in Examples II-12 and 13 were all evaluated to be rank A, but were slightly inferior to the other Examples which were evaluated to be rank A.

Third Embodiment

Suppression of Undertrapping

Two types of images a and b in FIG. 1A were formed on recording media (trade name: Canon Photo Paper Gloss Gold GL-101: made by Canon Inc.) which have an ink-receiving layer thereon, by using various types of inks shown in the following Table 4, with a recording duty set at 100%. At this time, a humidified air was supplied to control the atmosphere between the recording head and the recording medium to the conditions of the temperature and the relative humidity shown in Table 4. In addition, subsequently to the formation of the image, hot air was allowed to blow against the image on the conditions of the temperature and the period of time shown in Table 4 to dry the recording media which had the image formed thereon. The used ink jet recording apparatus is an apparatus in which the image forming portion in FIG. 3 was replaced with the configuration illustrated in FIG. 4. Specifically, the ink jet recording apparatus is an apparatus that has a first humidifying portion which performs the above described pre-humidification, a second humidifying portion which supplies a humidified air between a recording head and a recording medium when forming an image, a recording head which ejects ink by the action of thermal energy, and a drying portion which dries the recording medium that has an image formed thereon. Incidentally, when the pre-humidification is not performed, the first humidifying portion may not be provided. An evaluation sample was produced in the same way as that in the first embodiment except for the above-described conditions, and the suppression of the undertrapping was evaluated according to the same evaluation criteria. The results are shown in Table 4.

Reduction Rate of Undertrapping by Humidification And Drying:

The value ΔE measured on the above described evaluation sample (which was humidified and dried) was taken to be $\Delta E_1$, and the value ΔE obtained by producing an evaluation sample in the same way except that the sample was neither humidified nor dried, and then calculating the value on the obtained image in the same way as described above was taken to be $\Delta E_2$. Then, the reduction rate of the undertrapping by humidification and drying was evaluated from the value of the reduction rate (%) which was calculated based on the expression: reduction rate (%)=$100-\Delta E_1/\Delta E_2*100$. The evaluation criteria are as follows. The results are shown in Table 4.

A: Reduction rate was 70% or more.

B: Reduction rate was 40% or more and less than 70%.

C: Reduction rate was less than 40%.

Anti-Sticking Property:

Anti-sticking properties were evaluated according to the same procedure and evaluation criteria to those in the first embodiment except that various types of inks shown in the following Table 4 were used. The results are shown in Table 4.

TABLE 4

Evaluation conditions and results of third embodiment

| | | Evaluation condition | | | | | | Evaluation result | | |
|---|---|---|---|---|---|---|---|---|---|---|
| | | Ink number | Temperature of hot air [° C.] | Time period for hot air blowing [second] | Humidification temperature [° C.] | Absolute humidity [kg/kgDA] | Pre-humidifying step | Suppression of under-trapping | Reduction rate of under-trapping | Anti-sticking property |
| Example | III-1 | 1 | 70 | 10 | 35 | 0.015 | Not conducted | AA | A | A |
| | III-2 | 2 | 70 | 10 | 35 | 0.015 | Not conducted | AA | A | A |
| | III-3 | 3 | 70 | 10 | 35 | 0.015 | Not conducted | AA | A | A |
| | III-4 | 4 | 70 | 10 | 35 | 0.015 | Not conducted | AA | A | A |
| | III-5 | 5 | 70 | 10 | 35 | 0.015 | Not conducted | AA | A | A |
| | III-6 | 6 | 70 | 10 | 35 | 0.015 | Not conducted | A | A | A |
| | III-7 | 7 | 70 | 10 | 35 | 0.015 | Not conducted | AA | A | A |
| | III-8 | 8 | 70 | 10 | 35 | 0.015 | Not conducted | AA | A | A |
| | III-9 | 9 | 70 | 10 | 35 | 0.015 | Not conducted | AA | A | B |
| | III-10 | 1 | 70 | 10 | 35 | 0.015 | Conducted | AA | A | A |
| | III-11 | 1 | 50 | 10 | 35 | 0.015 | Not conducted | AA | A | A |
| | III-12 | 1 | 49 | 10 | 35 | 0.015 | Not conducted | A | A | A |
| | III-13 | 1 | 70 | 2 | 35 | 0.015 | Not conducted | AA | A | A |
| | III-14 | 1 | 70 | 1 | 35 | 0.015 | Not conducted | A | A | A |
| | III-15 | 1 | 70 | 10 | 35 | 0.013 | Not conducted | AA | A | A |
| | III-16 | 1 | 70 | 10 | 35 | 0.010 | Not conducted | A | A | A |
| | III-17 | 1 | 70 | 10 | 37 | 0.013 | Not conducted | A | A | A |
| Comparative Example | III-1 | 1 | | Not conducted | | | Not conducted | C | — | A |
| | III-2 | 10 | 70 | 10 | 35 | 0.013 | Not conducted | C | C | A |
| | III-3 | 11 | 70 | 10 | 35 | 0.013 | Not conducted | C | C | B |
| | III-4 | 12 | 70 | 10 | 35 | 0.013 | Not conducted | C | C | A |
| | III-5 | 13 | 70 | 10 | 35 | 0.013 | Not conducted | C | C | A |

Incidentally, the suppression of the undertrapping in Example III-10 was superior to the other Examples which were evaluated to be rank A. In addition, the reduction rates of the undertrapping in Examples III-6, 12, 14, 16 and 17 by humidification and drying were all evaluated to be rank A, but were slightly inferior to the other Examples which were evaluated to be rank A.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-141939, filed Jun. 22, 2010, which is hereby incorporated by reference herein in its entirety.

What is claimed is:

1. An ink jet recording method having a step of forming an image on a recording medium by ejecting an ink from an ink jet recording head, the method comprising performing:

a humidifying step of humidifying a gap between the recording head and the recording medium by supplying humidified air into the gap between the recording head and the recording medium, and setting the gap between the recording head and the recording medium to an atmosphere of a temperature of 35° C. or lower and an absolute humidity of 0.013 kg/kgDA or higher, wherein the recording medium has an ink-receiving layer that comprises a pigment, and wherein the ink used for forming the image is an ink which contains water, a water-soluble organic solvent and at least one of a compound represented by the following General Formula (I) and a compound represented by the following General Formula (II):

$$R_1 \text{—} R_3 \text{—} R_2 \quad (I)$$

wherein the compound represented by General Formula (I) is solid at 25° C.; $R_1$ and $R_2$ each independently represent a hydrogen atom, a hydroxy group, a substituted or unsubstituted amino group, a substituted or unsubstituted alkoxy group, a substituted or unsubstituted aminooxy group, a substituted or unsubstituted alkyl group, a substituted or unsubstituted alkenyl group, a substituted or unsubstituted alkynyl group, a substituted or unsubstituted aralkyl group, a substituted or unsubstituted aryl group, or a substituted or unsubstituted heterocyclic group; and $R_3$ is one of —S—, —S(═O)— and —S(═O)$_2$—; and (II)

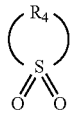

wherein the compound represented by General Formula (II) is solid at 25° C.; and $R_4$ is a molecular chain which constitutes a heterocycle together with a sulfur atom.

2. The ink jet recording method according to claim 1, wherein a content (mass %) of at least one of the compounds represented by the General Formula (I) and General Formula (II) in the ink used for forming the image is 2.0 mass % or more and 20.0 mass % or less with respect to the total mass of the ink.

3. The ink jet recording method according to claim 1, further comprising performing a drying step of drying the recording medium which has the image formed thereon.

4. The ink jet recording method according to claim 3, wherein the drying step is performed by allowing hot air having a temperature of 50° C. or higher to blow against the recording medium which has the image formed thereon for 2 seconds or longer.

5. The ink jet recording method according to claim 3, wherein the drying step is performed by blowing hot air against the recording medium or irradiating the recording medium with infrared rays or ultraviolet rays.

6. The ink jet recording method according to claim 5, wherein the drying step is performed by allowing hot air having a temperature of 50° C. or higher to blow against the recording medium which has the image formed thereon for 2 seconds or longer.

7. The ink jet recording method according to claim 1, wherein the ink-receiving layer has a porous structure including the pigment.

8. The ink jet recording method according to claim 1, wherein the pigment comprises at least one selected from the group consisting of silica, alumina and alumina hydrate.

9. An ink jet recording apparatus comprising an ink storage portion for storing an ink and an image forming portion for forming an image on a recording medium by ejecting the ink from an ink jet recording head, the apparatus further comprising:

a unit for humidifying a gap between the recording head and the recording medium by supplying humidified air into the gap between the recording head and the recording medium, and setting the gap between the recording head and the recording medium to an atmosphere of a temperature of 35° C. or lower and an absolute humidity of 0.013 kg/kgDA or higher, wherein the recording medium has an ink-receiving layer that comprises a pigment, and wherein the ink stored in the ink storage portion is an ink which contains water, a water-soluble organic solvent and at least one of a compound represented by the following General Formula (I) and a compound represented by the following General Formula (II):

$$R_1 \text{—} R_3 \text{—} R_2 \qquad \text{(I)}$$

wherein the compound represented by General Formula (I) is solid at 25° C.; $R_1$ and $R_2$ each independently represent a hydrogen atom, a hydroxy group, a substituted or unsubstituted amino group, a substituted or unsubstituted alkoxy group, a substituted or unsubstituted aminooxy group, a substituted or unsubstituted alkyl group, a substituted or unsubstituted alkenyl group, a substituted or unsubstituted alkynyl group, a substituted or unsubstituted aralkyl group, a substituted or unsubstituted aryl group, or a substituted or unsubstituted heterocyclic group; and $R_3$ is one of —S—, —S(═O)— and —S(═O)$_2$—; and (II)

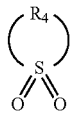

wherein the compound represented by General Formula (II) is solid at 25° C.; and $R_4$ is a molecular chain which constitutes a heterocycle together with a sulfur atom.

10. The ink jet recording apparatus according to claim 9, further comprising a unit for drying the recording medium that has the image formed thereon by blowing hot air against the recording medium or irradiating the recording medium with infrared rays or ultraviolet rays.

* * * * *